US008707664B1

(12) United States Patent
Bison

(10) Patent No.: US 8,707,664 B1
(45) Date of Patent: Apr. 29, 2014

(54) PALLET ROPING AND WRAPPING APPARATUS

(76) Inventor: Darrel Bison, Phoenix, AZ (US)

( * ) Notice: Subject to any disclaimer, the term of this patent is extended or adjusted under 35 U.S.C. 154(b) by 0 days.

(21) Appl. No.: 13/287,038

(22) Filed: Nov. 1, 2011

Related U.S. Application Data

(63) Continuation-in-part of application No. 12/551,167, filed on Aug. 31, 2009, now Pat. No. 8,046,975, which is a continuation of application No. 11/668,954, filed on Jan. 30, 2007, now Pat. No. 7,581,368.

(60) Provisional application No. 60/829,339, filed on Oct. 13, 2006, provisional application No. 60/829,085, filed on Oct. 11, 2006.

(51) Int. Cl.
*B65B 11/02* (2006.01)
*B65B 11/04* (2006.01)
*B65B 11/00* (2006.01)

(52) U.S. Cl.
CPC ..... *B65B 11/008* (2013.01); *B65B 11/006* (2013.01); *B65B 11/025* (2013.01); *B65B 11/04* (2013.01)
USPC ..... 53/587; 53/441; 53/449

(58) Field of Classification Search
CPC .... B65B 11/025; B65B 11/045; B65B 11/04; B65B 11/006; B65B 11/02; B65B 11/54; B65B 11/585; B65B 2011/002; B65B 2210/20; B65B 25/18; B65B 67/10; B65B 67/08
USPC ..... 53/556, 587, 588, 170, 176, 210, 211, 53/441; 242/118.41, 388, 388.6, 594, 242/594.3, 594.4, 603, 609, 609.1, 609.3, 242/588, 588.2
See application file for complete search history.

(56) References Cited

U.S. PATENT DOCUMENTS

| | | | | |
|---|---|---|---|---|
| 2,026,282 | A | | 12/1935 | Leguillon |
| 2,823,530 | A | * | 2/1958 | Rikard ..... 66/209 |
| 3,896,604 | A | | 7/1975 | Marantz |
| 4,102,513 | A | | 7/1978 | Guard |
| 4,166,589 | A | | 9/1979 | Hoover et al. |
| 4,235,062 | A | | 11/1980 | Lancaster et al. |
| 4,255,918 | A | | 3/1981 | Lancaster et al. |
| 4,353,515 | A | | 10/1982 | Weaver et al. |
| 4,468,922 | A | | 9/1984 | McCrady et al. |
| 4,530,473 | A | * | 7/1985 | Parry ..... 242/588.2 |
| 4,619,102 | A | | 10/1986 | Geisinger |
| 4,739,945 | A | * | 4/1988 | Yokoe ..... 242/118.41 |
| 4,807,427 | A | | 2/1989 | Casteel et al. |
| 4,845,920 | A | | 7/1989 | Lancaster |
| 4,961,306 | A | | 10/1990 | Sawhney et al. |
| 5,031,771 | A | | 7/1991 | Lancaster |
| 5,079,898 | A | | 1/1992 | Springs et al. |

(Continued)

*Primary Examiner* — Hemant M Desai
(74) *Attorney, Agent, or Firm* — Booth Udall Fuller, PLC

(57) ABSTRACT

Pallet roping and wrapping machines having a plurality of spools of stretch film supported on one or more spools and guides that form ropes of stretch film without cutting. Specific implementations of guides include guides formed or rings and rollers. Positions of guides may be adjustable. A first roll of stretch film may be positionally coupled to a first spool core, and a second roll of stretch film may be positionally coupled to a second spool core. Rotationally coupling of the first and second spool cores to each other results in the rolls of film and the spool cores all rotating at the same rate when the stretch film is unrolled and passed through a plurality of a guides.

10 Claims, 15 Drawing Sheets

(56) References Cited

U.S. PATENT DOCUMENTS

| | | | | | |
|---|---|---|---|---|---|
| 5,107,657 | A | | 4/1992 | Diehl et al. | |
| 5,125,209 | A | | 6/1992 | Thimon et al. | |
| 5,168,685 | A | * | 12/1992 | Suzuki | 53/141 |
| 5,195,297 | A | * | 3/1993 | Lancaster et al. | 53/399 |
| 5,203,939 | A | | 4/1993 | Sperling et al. | |
| 5,211,353 | A | * | 5/1993 | Lewin et al. | 242/118.41 |
| 5,315,808 | A | | 5/1994 | MacIvor et al. | |
| 5,385,001 | A | | 1/1995 | Ramer | |
| 5,447,009 | A | | 9/1995 | Oleksy et al. | |
| 5,535,962 | A | * | 7/1996 | Bargowski | 242/594.3 |
| 5,965,262 | A | | 10/1999 | Whisler et al. | |
| 6,164,047 | A | | 12/2000 | Rossi | |
| 6,745,544 | B2 | | 6/2004 | Matsumoto et al. | |
| 6,892,515 | B2 | | 5/2005 | Cere' | |
| 6,971,220 | B1 | | 12/2005 | Rampp | |
| 8,053,056 | B2 | | 11/2011 | Heikaus et al. | |
| 8,276,349 | B2 | | 10/2012 | Van Amstel et al. | |
| 2008/0092489 | A1 | | 4/2008 | Smith | |
| 2008/0209859 | A1 | | 9/2008 | Vanderheiden et al. | |

* cited by examiner

PALLET ROPING AND WRAPPING APPARATUS

CROSS REFERENCE TO RELATED APPLICATIONS

This application is a continuation-in-part of U.S. Patent application entitled PALLET ROPING AND WRAPPING APPARATUS, Ser. No. 12/551,167, filed Aug. 31, 2009, issuing as U.S. Pat. No. 8,046,975 on Nov. 1, 2011, which is a continuation of U.S. Utility Patent Application entitled PALLET ROPING AND WRAPPING APPARATUS Ser. No. 11/668,954 which was filed on Jan. 30, 2007, and is now U.S. Pat. No. 7,581,368, which claims the benefit of the filing date of U.S. Provisional Patent Application No. 60/829,339, entitled HAND ROPER, which was filed on Oct. 13, 2006, and of the filing date of U.S. Provisional Patent Application No. 60/829,085, entitled RAPIDROPER, which was filed on Oct. 11, 2006, the contents of each of which are each hereby incorporated herein by reference.

BACKGROUND

1. Technical Field

Aspects of this document relate generally to securing and protecting palletized loads.

2. Background Art

Goods to be transported in containers on, for example, ships, trucks, trains or the like frequently are packed on pallets. Such palletized goods or material, further, may be wrapped in stretch film in order to protect the material from damage caused by, for example, shifting on a pallet or being bumped by goods on adjacent pallets.

Material such as furniture or boxed goods may be completely wrapped in contiguously overlapping stretch film, effectively sealing wrapped material from contact with air or from contact with other material, which may be, for example, on other pallets. However, other types of material, such as, for example, fresh fruits and vegetables, require that air be allowed to circulate among the palletized material in order to prevent buildup of condensation or to aid in cooling or warming the material. One known method for packing these kinds of goods includes wrapping the palletized material in netting, or with a rope rather than in stretch film.

SUMMARY

According to a first aspect of particular embodiments and implementations disclosed, an apparatus for securing a palletized load, the apparatus may comprise a plurality of spool cores removably coupled to each other by a coupling clip and supported by a spool support member, the coupling clip directly contacting at least one end of each of the plurality of spool cores, a first roll of stretch film wound around a first spool core of the plurality of spool cores and at least a second roll of stretch film wound around at least a second spool core of the plurality of spool cores such that the first and the at least a second spool cores are rotationally coupled to the respective first and the at least second rolls of stretch film, respectively, wherein the first roll, the at least a second roll, the first spool core, and the at least a second spool core all rotate at the same rate when the first and the at least a second rolls are unrolled through the first and second spool cores being rotationally coupled together by the coupling clip, and a plurality of guides positioned adjacent to the spool support member, each guide having stretch film from one of either the first roll or the at least second roll passed through the guide, thereby forming a plurality of stretch film wraps passing through the plurality of guides, wherein a width of the stretch film wrap passing through each of the plurality of guides is determined by a width of the respective guide through which the stretch film wrap passes.

Particular implementations and embodiments may comprise one or more of the following features. The coupling clip may comprise at least one clip separate from the first spool core and the second spool core, wherein at least one coupling clip is coupled directly to the first spool core and to the second spool core such that the first spool core and the second spool core rotate at the same rate. The first and the at least a second spool core may be coupled together by a portion of the at least second spool core fitting within at least a portion of the first spool core, and the coupling clip comprises a pin that fits within corresponding holes on each of the first and the at least a second spool core. The coupling clip may comprise coupling teeth on a first end of each of the first spool core and the at least second spool core, wherein the first and the at least second spool core are coupled together through the coupling clip when the coupling teeth of the first spool core mechanically engage the coupling teeth of the at least a second spool core. The first and the at least a second spool core may be coupled together through the coupling clip when an extension on the first spool core that engages a receiver on the at least second spool core. The first and the at least second spool core may be coupled together with a screw such that the first spool core and the second spool core rotate at the same rate. A position of each of the plurality of guides may be independently adjustable on the support member. The coupling clip may comprise a coupling ring that attaches directly to an end of each of the first spool core and the at least a second spool core.

In another aspect, a method of securing a palletized load may comprise providing an apparatus including a support member supporting a plurality of spool cores coupled to each other, a first roll of stretch film wound around a first spool core of the plurality of spool cores and at least a second roll of stretch film wound around at least a second spool core of the plurality of spool cores, and a plurality of adjustable guides adjacent to the support member and configured to move further apart and closer together, rotationally coupling the first spool core to the second spool core such that the first spool core and the second spool core necessarily rotate at the same rate, unrolling stretch film from the first roll and stretch film from the second roll at the same rate under tension, passing, at the same rate, stretch film from each of the first and the at least second rolls through a guide of the plurality of guides to form a first and at least a second stretch film band under tension, adjusting a characteristic of the first stretch band wrap by adjusting a width of a first guide of the plurality of adjustable guides through which the first stretch film band passes, and securing the palletized load through wrapping the palletized load with the plurality of stretch film bands after passing the stretch film through the plurality of guides.

Particular implementations and embodiments may comprise one or more of the following features. Coupling the first spool core to the at least a second spool core. Coupling the first spool core to the at least a second spool core may comprise removably coupling the first spool core to the at least a second spool core with a screw. Coupling the first spool core to the at least a second spool core may comprise removably coupling the first spool core to the at least a second spool core with a pin and lock mechanism. Coupling the first spool core to the at least a second spool core may comprise removably coupling the first spool core to the at least a second spool core with engaging teeth on abutting ends of the first spool core and the at least second spool core. Coupling the first spool core to the at least a second spool core may comprise inserting a portion of the at least a second spool core into a portion of the first spool core. Adjusting a width of the first guide may comprise moving a first roller of the guide farther apart from a second roller of the guide to form a wider stretch film band. Securing the palletized load may comprise rotating the palletized load relative to a stationary position of the spool support member for the plurality of the guides and wrapping the first and the at least a second stretch film bands around the palletized load. Adjusting a characteristic of a second stretch film wrap of the plurality of stretch film wraps by adjusting a width of a second guide through which the second stretch film band passes. Securing may comprise circumnavigating the palletized load with the plurality of guides to wrap the plurality of stretch film wraps around the palletized load.

In another aspect, a spool of stretch film for securing a palletized load may comprise a plurality of spool cores rotationally coupled to each other such that the spool cores necessarily rotate at the same rate, at least a first roll of stretch film positionally coupled to and wound around a first spool core of the plurality of spool cores, at least a second roll of stretch film positionally coupled to and wound around at least second spool core of the plurality of spool cores, wherein by both the at least first roll of stretch film and the at least second roll of stretch being positionally coupled to the first spool core and the second spool core, respectively, and by the first spool core being coupled to the at least second spool core, both the at least a first roll of stretch film and the at least a second roll of stretch film will simultaneously rotate at the same rate as the as the plurality of spool cores when the at least first roll and the at least second roll are unrolled.

Particular implementations and embodiments may comprise one or more of the following features. An axis of rotation of the plurality of spool cores, the at least a first roll comprising a first center axis and the at least a second roll comprising a second center axis, wherein the first center axis and the second center axis coincide with the axis of rotation of the plurality of spool cores.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Various aspects of implementations of pallet wrapping and roping machines will hereinafter be described in conjunction with the appended drawings, where like designations denote like elements, and.

DESCRIPTION

This disclosure, its aspects and implementations, are not limited to the specific devices and methods disclosed herein. Many additional elements, components, and procedures known in the art consistent with the intended use of the apparatus and methods described will become apparent for use with various implementations of pallet-wrapping apparatus and techniques from this disclosure. Accordingly, for example, although a particular apparatus may be disclosed, such apparatus may comprise any shape, size, style, type, model, version, material, and/or the like as is known in the art for such apparatus, consistent with the intended operation of the devices described herein.

Figure 1:
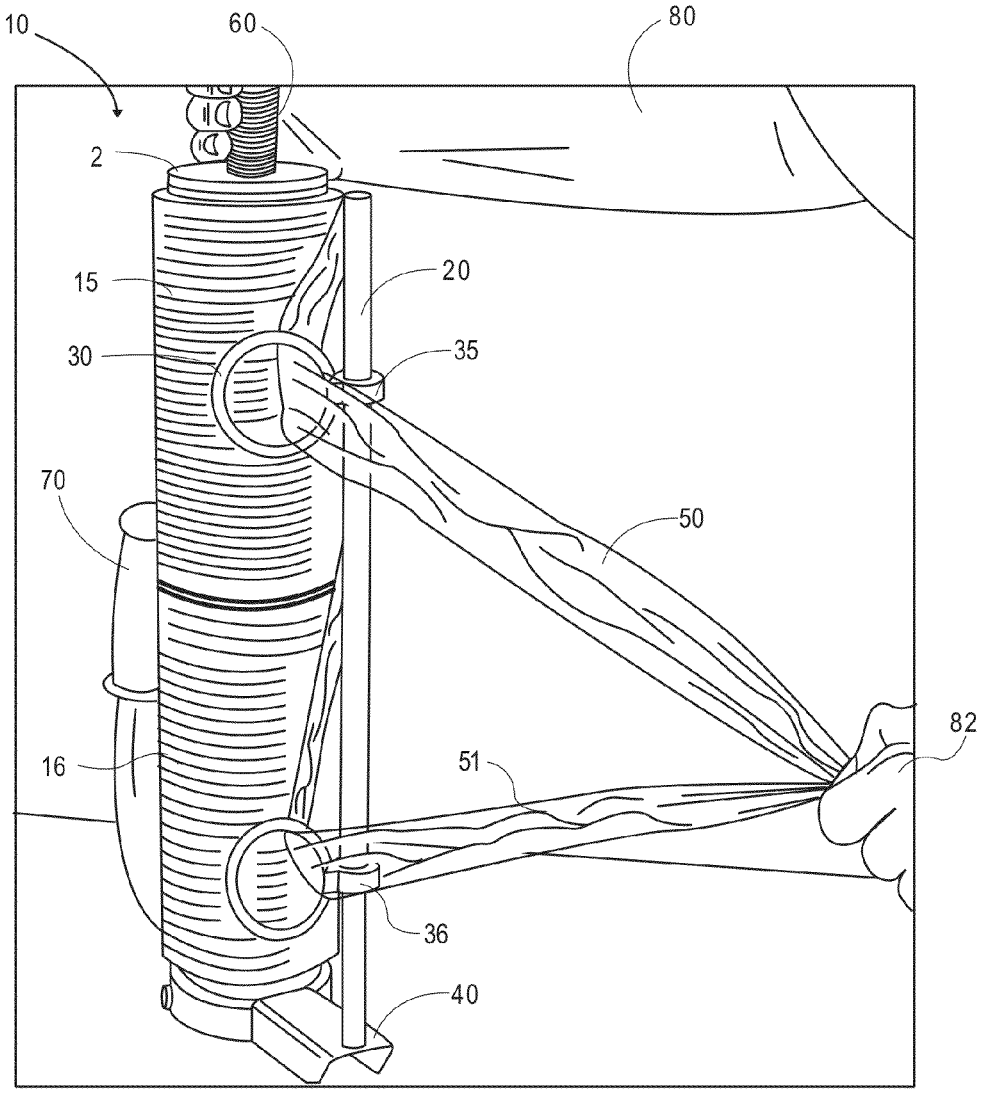
FIG. 1 is a pictorial diagram of a particular implementation of an apparatus for wrapping palletized loads.

A particular implementation of a pallet roping and wrapping apparatus 10, which may be employed for securing a palletized load, is shown in FIG. 1. The apparatus 10 comprises a first roll 15 and a second roll 16 of stretch film and a single spool 2 configured to support the first and second rolls 15 and 16 of stretch film. The first and second rolls 15 and 16 may be positioned essentially contiguously on the spool 2. The apparatus 10 further may comprise a baseplate 40 and a spool support member (which may be a rod, not shown) adapted to support the spool 2, the spool support member having an end affixed to and supported by the baseplate 40. The spool 2 may have an axis that typically coincides with a center axis shared by the first and second rolls 15 and 16 of stretch film. The illustrated implementation still further comprises a pair of guides, first guide 30 and second guide 31, and a guide support member 20, which may comprise, for example, a rod. The guide support member 20 may have an end coupled to and supported by the baseplate 40. That is, the spool support member and the guide support member 20 may share mechanical support provided by the baseplate 40. The guide support member 20 may have an axis oriented to be substantially parallel to the axis of the spool 2 in normal operation. In the illustrated implementation of FIG. 1, the first and second guides 30 and 31 are formed as rings. First guide 30 is secured to the guide support member 20 by a first collar 35 that may be adjustably positioned on the guide support member 20 at a location nominally opposite a midpoint of the first roll 15. Likewise, second guide 31, which also may have an adjustable position according to a location of a second collar 36, may be located nominally opposite a midpoint of the second roll 16. The illustrated positions of first and second guides 30 and 31 are only examples, as positions of the first and second guides 30 and 31 may be adjusted in either a ganged fashion or independently according to needs or preferences of a user of the apparatus 10.

Stretch film from first and second rolls 15 and 16 may be threaded or otherwise passed through first and second guides 30 and 31 to form a first rope 50 and a second rope 51 of stretch film. It should be noted that in the industry a "rope" is also sometimes called a "band." It should also be noted that there is no need to cut or otherwise modify, distort, or weaken the stretch film coming from the roll. Any such cutting, modifying, or distorting is obviated by the use of separate first and second rolls 15 and 16 of stretch film. Indeed, known devices that require cutting of stretch film or that employ cutting or distorting of stretch film in their operation may cause inconvenience and expense to users of the known devices as a result of consequential breaking and/or tearing of the stretch film.

It should be understood that the present disclosure contemplates using a plurality of rolls of stretch film and that first and second rolls 15 and 16 in the particular implementation illustrated in FIG. 1 are not intended to be limiting. Likewise, particular implementations of apparatus for securing palletized loads may comprise a plurality of guides (e.g., first and second guides 30 and 31, or more) being adjustably secured to a guide support member 20 by a plurality of collars (e.g., first and second collars 35 and 36). An implementation comprising such a plurality of rolls and guides may be employed to form a plurality of ropes (e.g., first and second ropes 50 and 51, or more) of stretch film with which to wrap or otherwise secure a palletized load.

Adjustment of positions of the guides (e.g., first and second guides 30 and 31) may be accomplished in one exemplary implementation using set screws (not shown) employed in the collars in a conventional manner. Adjustable clamps may replace the collars in other implementations without departing from any intention of the present disclosure.

Figure 2:
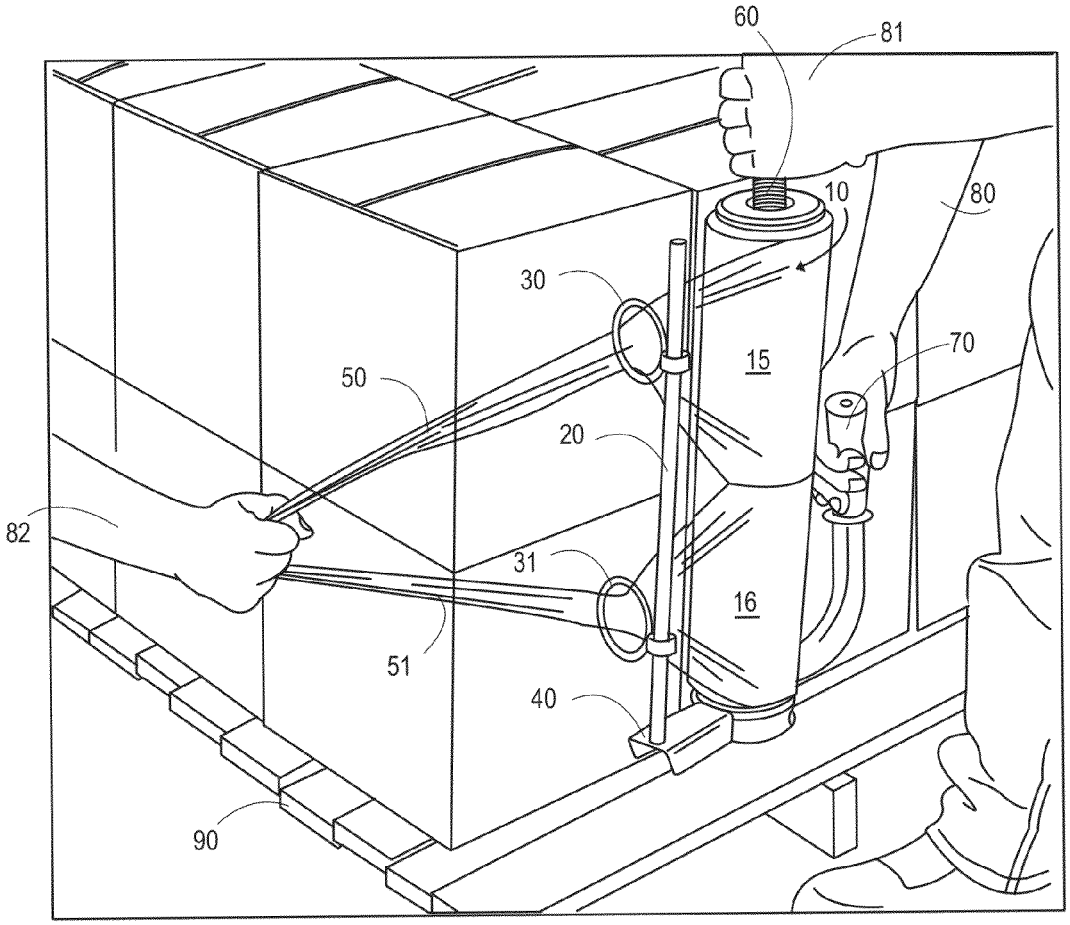
FIG. 2 is a pictorial diagram of the particular implementation of FIG. 1 illustrating hand-held use of the apparatus.

An axial handle 60 may be coupled to an end of the spool support member, the axial handle having an axis nominally aligned with the center axis shared by the spool support member and the first and second rolls 15 and 16 of stretch film. A side handle 70, further, may be affixed to the baseplate 40. A first user supporting the apparatus would hold both the axial handle 60 and the side handle 70. Arm 80 and hand 81 (See FIGS. 1 and 2) are from the user supporting the apparatus. A second user may draw the first and second ropes 50 and 51 using hand 82. The side handle 70 and the axial handle 60 may be employed by a user to support the particular apparatus 10 as illustrated in FIG. 2. Alternative or differently configured handles may be used. As is further illustrated in FIG. 2, the side handle 70 and the axial handle 60 may be employed by a user move the apparatus 10 around a palletized load in order to extend first and second ropes 50 and 51, thereby wrapping and/or securing the palletized load.

For example, a first user may support the apparatus 10 by using a hand on a first arm 80 to grasp the side handle 70 and a second hand 81 to grasp the axial handle 60. First and second ropes 50 and 51 may be grasped by a hand 82 of a second user to hold ends of the first and second ropes 50 and 51 while the first user circumnavigates (e.g., walks around) a palletized load situated on a nominally stationary pallet 90, thereby wrapping and securing the palletized load. In another particular implementation described more particularly with reference to FIG. 6, a pallet wrapping device remains stationary while a palletized load is rotated in order to accomplish wrapping of ropes of stretch film around the load.

Figure 3A:
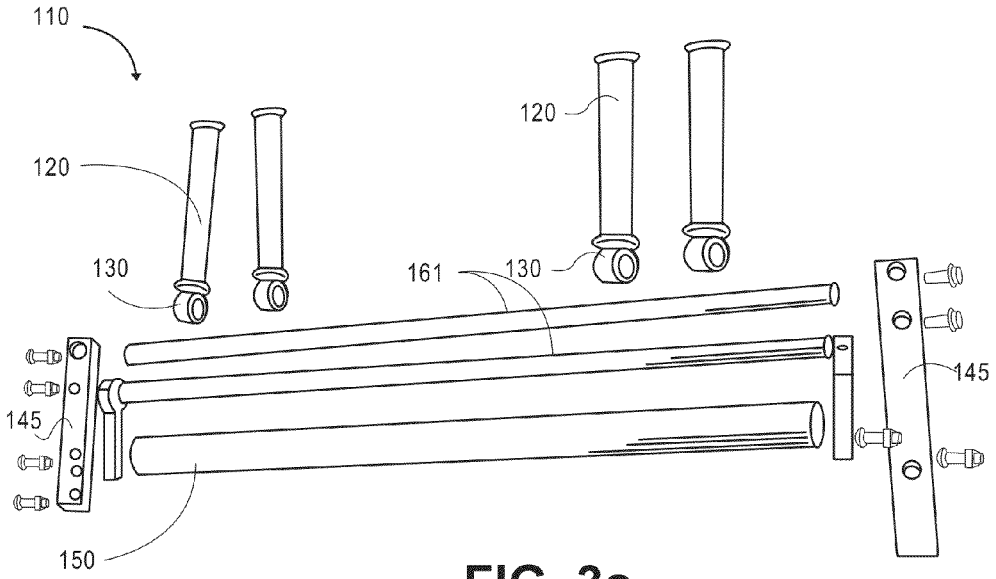
FIG. 3*a* is a disassembled view of a subassembly of another particular implementation of a palletized load-wrapping apparatus.
Figure 3B:
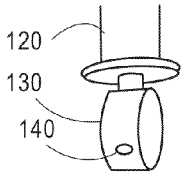
FIG. 3*b* is a close-up view of a portion of FIG. 3*a;*

FIG. 3*a* is a disassembled view of a subassembly 110 of a particular implementation of a stretch wrap machine 170 (FIG. 5), which may function as a palletized load wrapping apparatus. Elements of this subassembly 110 of the stretch wrap machine 170 include a plurality of rollers 120 (four are shown in FIG. 3*a*), which may be used to form guides that may perform a function similar to first and second guides 30 and 31 introduced in FIGS. 1 and 2. The rollers 120 may have affixed thereto collars 130 that may slidably and adjustably fit over a rod 161 having first and second ends, the rod 161 being adapted to function as a supporting member for the plurality of rollers 120. The collars 130 may include set screws 140 suitable for facilitating adjustment of positions of the plurality of rollers 120 along the rod 161. The illustrated subassembly 110 further comprises a pair of brackets 145 adapted to provide mechanical support for the first and second ends of the rod 161. FIG. 3*b* is a close-up view of the collars 130, rollers 120 and set screws 140.

Figure 4:
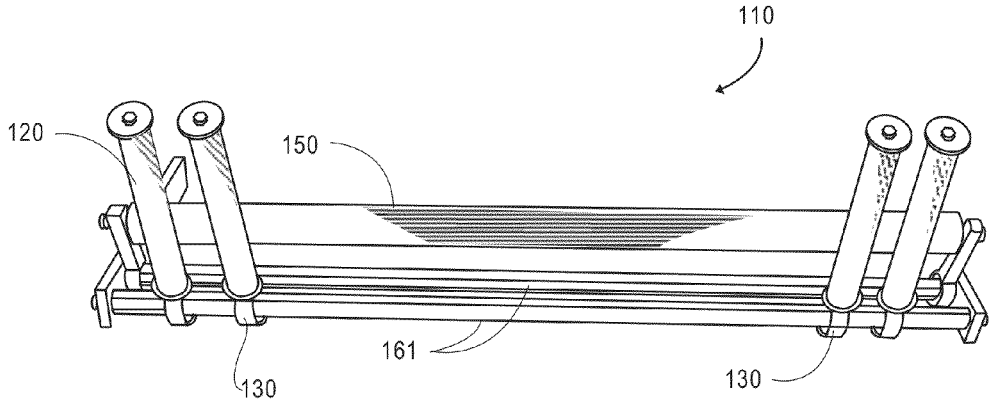
FIG. 4 is a view of the subassembly of FIG. 3*a* when assembled.

FIG. 4 is a partially-assembled subassembly 110 of FIG. 3*a* illustrating the plurality of rollers 120 affixed to the supporting member or rod 161 by collars 130. The partially-assembled subassembly 110 further includes a wrap machine roller 150 having ends mechanically secured by the pair of brackets 145 that also secure ends of the rod 161 in a manner well-understood by one skilled in the art.

Figure 5:
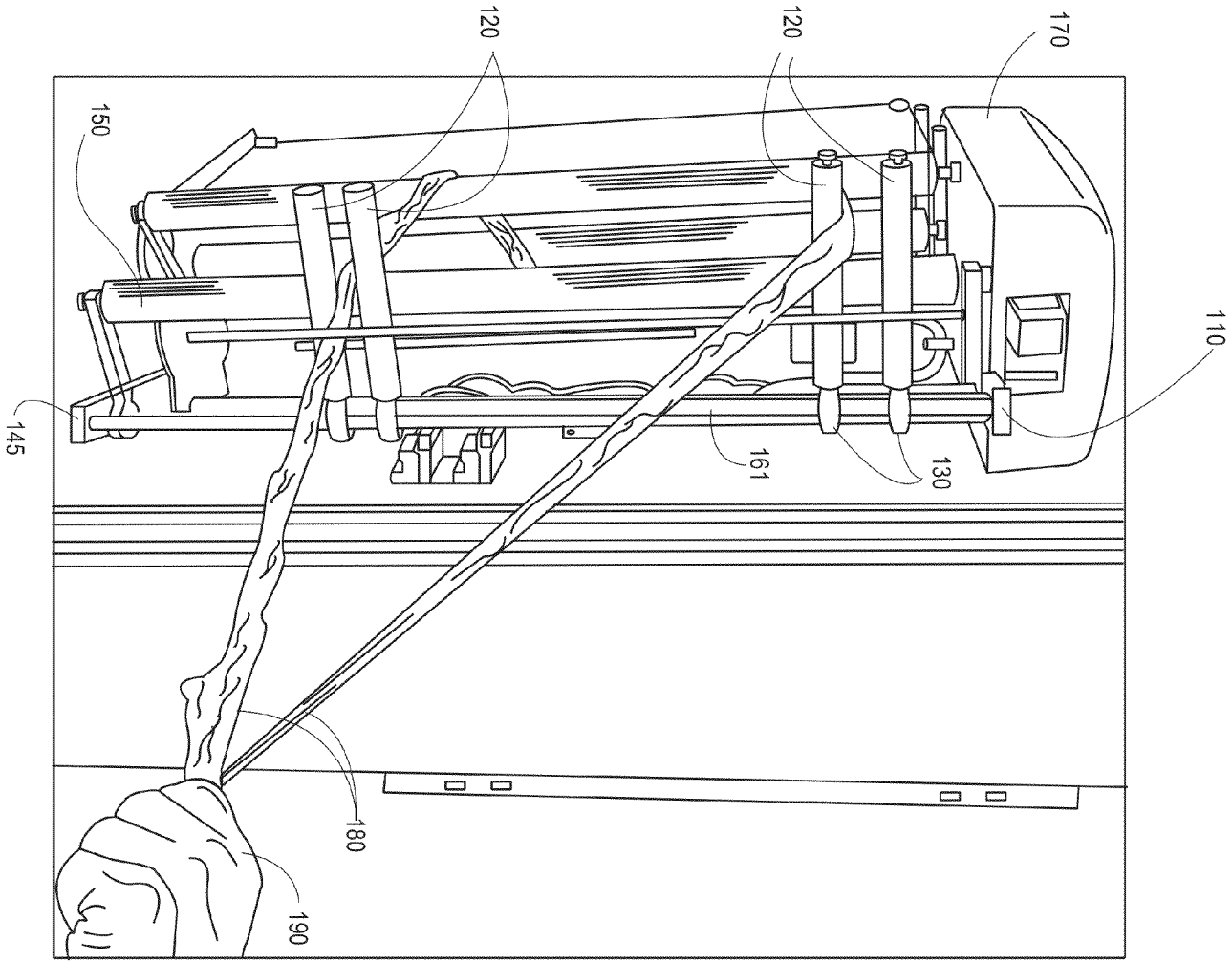
FIG. 5 is a pictorial diagram of a stretch wrap machine that includes a particular implementation of a rope-forming apparatus.

FIG. 5 is a pictorial diagram of a stretch wrap machine 170 that includes the subassembly 110 described above with reference to FIGS. 3 and 4. The stretch wrap machine 170, which may be employed as a palletized load-wrapping apparatus, may be configured for applications suited to wrapping palletized loads that arrive at the stretch wrap machine 170 on, for example, a conveyer belt, front loader or other transport medium. Typical implementations of the stretch wrap machine 170 include a rotating platform (not shown) on which may be placed a palletized load ready for wrapping. A driving mechanism (not shown) may cause the platform to rotate while a remainder of the stretch wrap machine 170 remains essentially stationary relative to the palletized load intended to be secured by the stretch wrap machine 170. It is understood that "stationary" in the present context means that the palletized load may be free to rotate, but that the load does not undergo translational motion once it arrives at the stretch wrap machine 170 until after any wrapping procedure is completed.

The implementation of the stretch wrap machine 170 illustrated in FIG. 5 comprises the subassembly 110 described in greater detail with reference to FIGS. 3 and 4. The illustrated implementation further comprises elements not shown in FIG. 5, but that may be similar to those illustrated in another implementation 270 of a stretch wrap machine shown in FIG. 6. These elements may include a spool 202, and a plurality of rolls of stretch film, e.g., first roll 215 and second roll 216 disposed essentially adjacently on the spool 202.

Returning to FIG. 5, stretch film may be passed between pairs of rollers 120, which may function as guides, thereby forming ropes 180 of stretch film. Although two pairs of rollers 120 and two ropes 180 are illustrated in FIG. 5, the description applies as well to a plurality of pairs of rollers, which may facilitate forming of a corresponding plurality of ropes of stretch film. As the palletized load rotates and a starting point for the plurality of ropes of stretch film is established on the palletized load, the palletized load may become wrapped with the plurality of ropes of stretch film.

Figure 6:
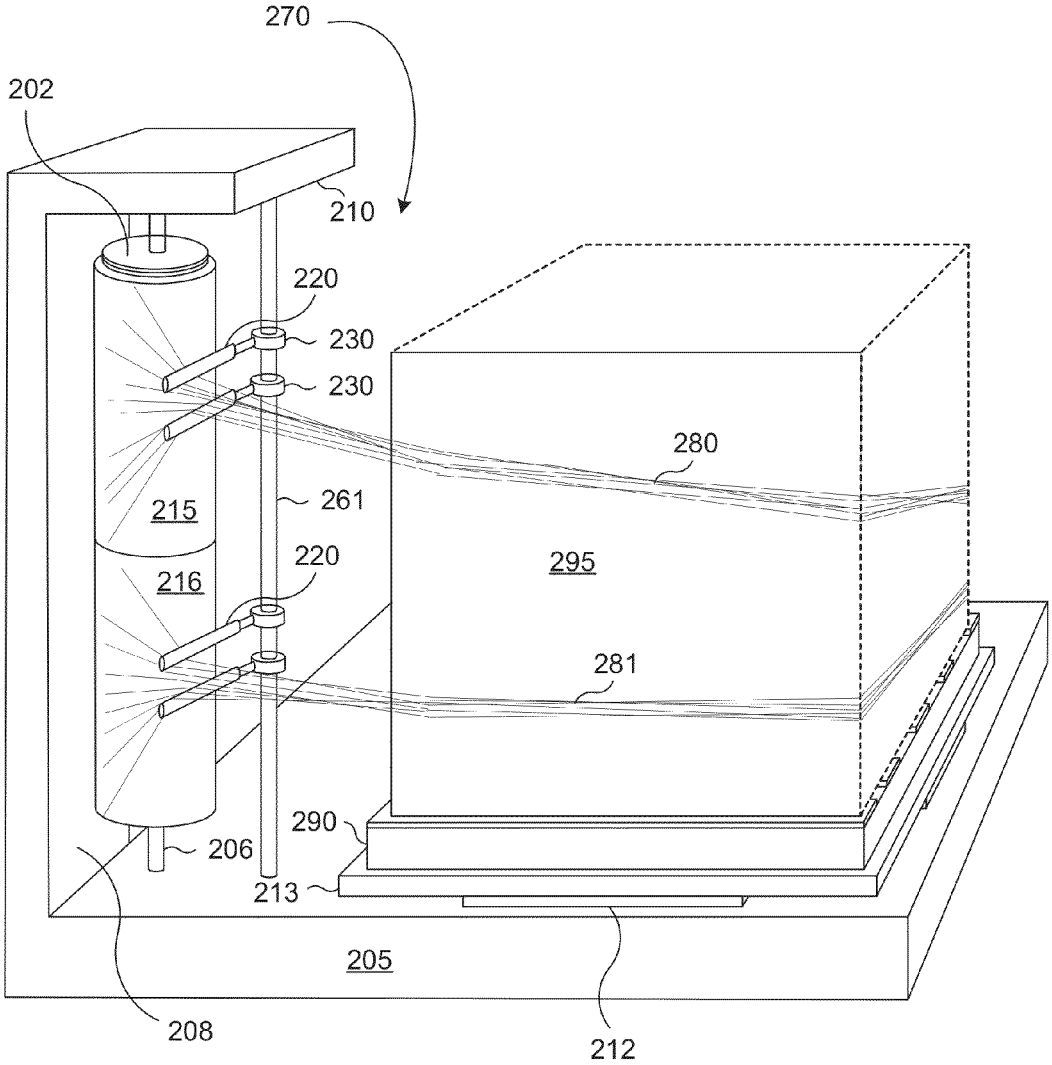
FIG. 6 is a pictorial diagram of a stretch wrap machine.

FIG. 6 is a pictorial diagram of a stationary stretch wrap machine 270 that may include elements described with reference to FIG. 5. The illustrated implementation comprises a spool 202 mounted on a spool support member 206, which is coupled at a first end on a platform 205 and supported on a second end by a bracket 210 that is essentially rigidly connected with the platform 205 by a connecting member 208. The spool 202 has disposed (e.g., wound) thereon first and second rolls 215 and 216 of stretch film, axes of the first and second rolls 215 and 216 essentially coinciding with an axis of the spool 202. Typically, first and second rolls 215 and 216 are disposed next to each other on the spool. The first and second rolls 215 and 216 may be disposed directly on the spool or disposed on separate spools that are then disposed on a common spool or roller (e.g. a common core with two spools around it and coupled to it) with the purpose that the first and second rolls necessarily unroll at substantially the same rate. If the first and second rolls 215 and 216 do not spin at substantially the same rate, as is necessitated by being on the same spool 202 or being otherwise equivalently forced to spin at substantially the same rate, the operation is less effective.

A guide support member 261, which is supported at a first end by the platform 205 and at a second end by the bracket 210, may be disposed nominally parallel to and at a convenient distance from the spool 202. That is, guide support member 261 may have an axis that is parallel to the axis of the spool 202. A plurality of rollers 220, which may be arranged in pairs to form guides, two of which are illustrated, for example, in FIG. 6, are adjustably connected with the guide support member 261 by a plurality of collars 230. The collars 230 may be configured so that positions of the plurality of rollers 220 may be adjusted.

Stretch film from the first and second rolls 215 and 216 pass through a pair of guides (formed by pairs of rollers 220 in the implementation shown in FIG. 6), forming first and second ropes 280 and 281 of stretch film. This disclosure, further, contemplates using two or more rolls, i.e., a plurality of rolls of stretch film in order to form a plurality of ropes of stretch film, by passing the stretch film through a plurality of guides although only two rolls, guides and ropes are illustrated in FIG. 6.

The platform 205 may have disposed thereon a support 212 that supports a rotatable platform 213 on which may be placed a pallet 290 of palletized goods 295 shown in dotted outline in FIG. 6 to reflect an arbitrary nature of an arrangement of the palletized goods 295. In operation, the pallet 290 and the palletized goods 295 may arrive at the stretch wrap machine 270 and may be placed onto the rotatable platform 213. First and second ropes 280 and 281 of stretch film may be formed as described herein and attached at initial ends (not illustrated) to the palletized load 295 in a known manner. The rotatable platform 213 then may be rotated (using, for example, a known type of motor and shaft arrangement not shown in FIG. 6), thereby pulling stretch film through the guides and extending first and second ropes 280 and 281 to wrap the palletized goods 295 as already described. It may be well to point out that although the stretch wrap machine 270 includes a rotating platform 213, portions of the stretch wrap machine 270 that form the stretch ropes 280 and 281 (i.e. the palletized load-securing apparatus) are fixed relative to the palletized load 295 being secured and relative to the rotatable platform 213.

Referring now to FIGS. 13-16, in some implementations the stretch wrap machine may comprise a plurality of spool cores and a plurality of rolls of stretch film, at least one on each of the spool cores. In these and other implementations, the plurality of spool cores may be coupled to one another with a coupling clip in such a manner that each of the plurality of spool cores and each of the plurality of rolls of stretch film all simultaneously rotate at the same rate as the plurality of rolls are unwound. Particular manners of coupling the plurality of spool cores to one another described herein are example implementations and do not encompass each and every implementation contemplated. For example, while each of FIGS. 13-16 illustrate two spool cores and two rolls of stretch film, other implementations may comprise any number of a plurality of spool cores coupled together and any number of rolls of stretch film. Furthermore, in some implementations, any number of rolls of stretch film may be associated with a single spool core.

Positionally coupling the plurality of rolls of stretch film to the plurality of spool cores, and coupling the plurality of spool cores to one another results in a uniform rotation rate of each of the plurality of spool cores and plurality of rolls about an axis. This uniform rotation rate assists in maintaining a uniform tautness of the plurality of stretch film wraps as the palletized load is wrapped. Studies have shown that maintainance of a taut stretch film wrap as the palletized load is wrapped results in a more effectively wrapped and secured palletized load, resists undesired stretch wrap tearing during the wrapping process, and allows much less stretch wrap to be used.

In various implementations, the plurality of coupling devices may either be removably or permanently coupled to one another. As illustrated herein, some implementations utilize a clip to couple the spool cores together. The clip(s) may be integral to the first and/or second spool core, or may be a separate clip. In some implementations, the plurality of spool cores may be further or alternatively be coupled to a separate core to assist with uniform rotation. In such an implementation, the core would then rotate at the same rate as the plurality of spool cores and the plurality of rolls.

Figure 13:
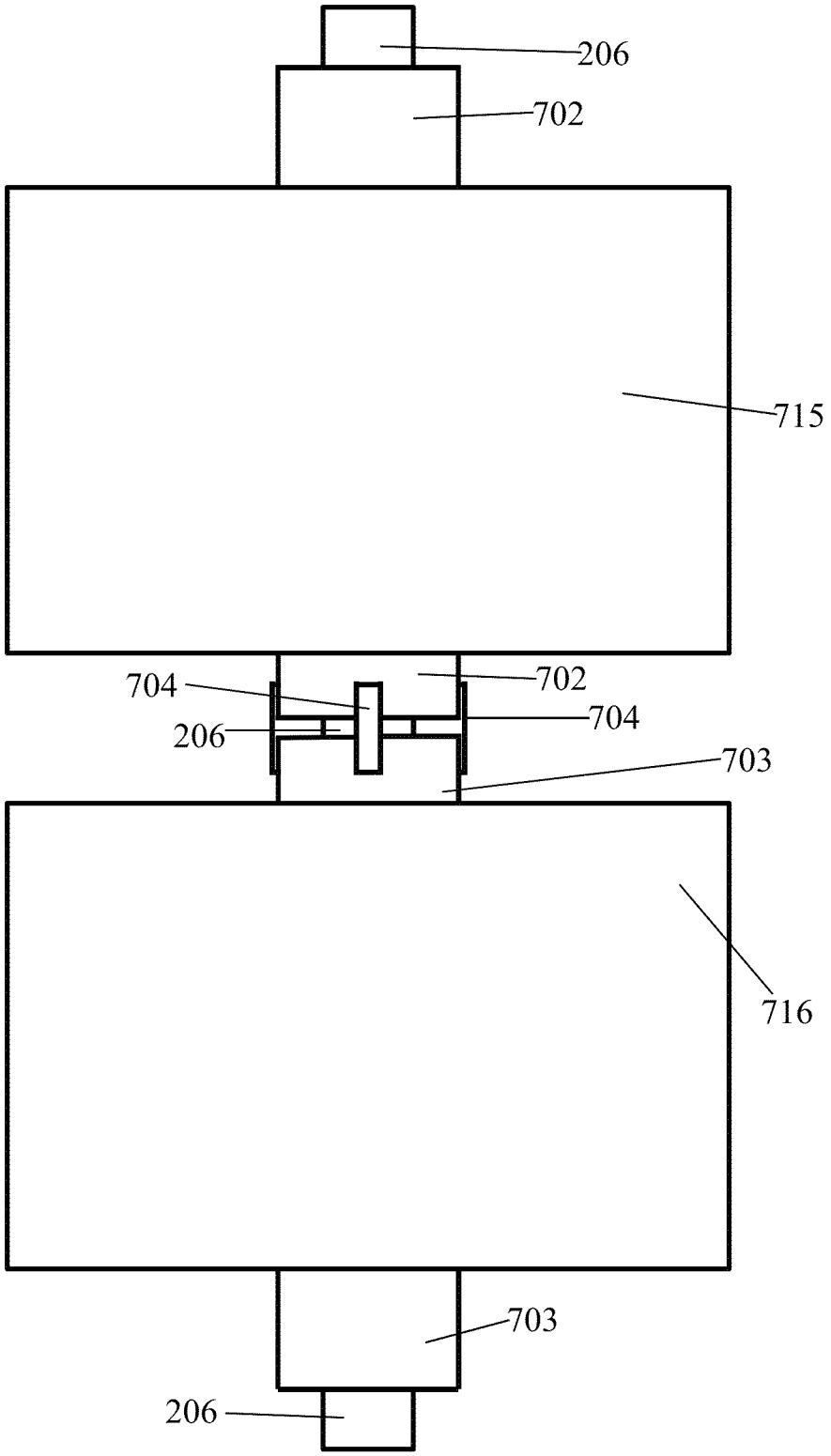
FIG. 13 is a front view of an implementation comprising two spool cores coupled together with coupling clips.

Referring specifically to FIG. 13, a first spool core 702 coupled to a second spool core 703 and supported by a support member 206 is illustrated. In the implementation of FIG. 13, the first spool core 702 is coupled to the second spool core with a plurality of coupling clips 704. The coupling clips 704 may be comprised of any variety of materials, such as but not limited to plastics, metals, rubbers, and the like. Furthermore, the coupling clips 704 may comprise any size or dimension. In the implementation illustrated in FIG. 13, there is a space between the first spool core 702 and the second spool core 703, and an even larger space between the first roll 715 and the second roll 716, though this is not required. In other implementations, the first spool core 702 and the second spool core 703 may abut one another. Likewise, in some implementations the first roll 715 and the second roll 716 may nearly abut one another or form a nearly contiguous surface. In some implementations, only a single coupling clip 704 may couple the first spool core 702 and the second spool 703 together. In other implementations, any number of coupling clip 704 may couple the first 702 and second 703 spool cores together. The coupling clip in this and other embodiments and implementations described hereafter causes the first roll 715 and the second roll 716 to rotate at the same rate about the support member as if they were one a single, contiguous core.

The coupling clip 704 may comprise a protrusion, nub, or at least one pyramid like point near each end of the coupling clip on a surface that faces the plurality of spool cores 702, 703. The plurality of spool cores 702, 703 may further comprise holes or depressions to mate with the protrusion, nub, or pyramid of the coupling clip 704. In other implementations, the pyramid like points may be pressed into the surface of the spool core 702, 703, thus attaching the coupling clip 704 to the spool core. In still other implementations, the coupling clip 704 or the plurality of spool 702, 703 cores may comprise an adhesive that adheres the coupling clip 704 to the spool core 702, 703. The coupling clips 704 may, in other implementations, comprise any type of mechanism or compound for coupling the clip 704 to the spool core 702, 703.

Figure 14:
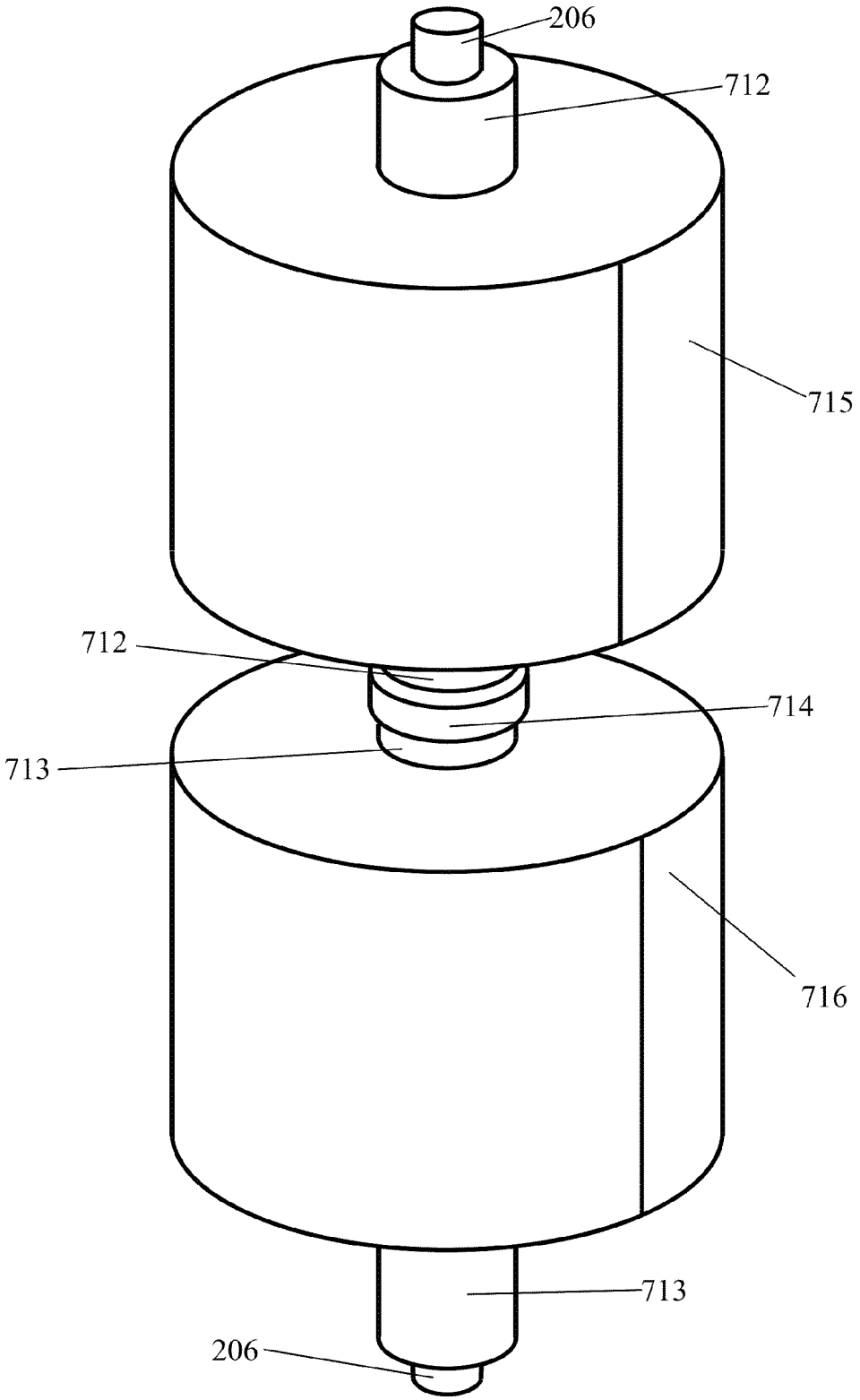
FIG. 14 is a perspective view of an implementation comprising two spool cores coupled together with a ring-shaped coupling clip.

Referring specifically to FIG. 14, another implementation comprising a first spool core 712 coupled to a second spool core 713 is illustrated. In the implementation of FIG. 14, the first spool core 712 and the second spool core 713 are coupled together with a coupling clip 714 in the form of a coupling ring 714. The coupling ring 714 may comprise any variety of materials, such as but not limited to plastics, metals, rubbers, and the like. In the implementation illustrated in FIG. 14, the spool core 712, 713 each fit within the coupling ring 714. In other implementations, the support member 206 may fit within the coupling ring 714, while the coupling ring fits within the ends of the spool core 712, 713. The coupling ring 714 may attach to the spool cores 712, 713 through a number of different manners.

For example, in an implementation, the spool core 712, 713 may each comprise threading that allows the spool core 712, 713 to be screwed into corresponding threading on the coupling ring 714. Similarly, coupling ring 714 may be screwed into the ends of the either or both the spool cores 712, 713. In other implementations, an adhesive may be use to attach the coupling ring 714 to the spool cores 712, 713. The adhesive may be utilized whether the coupling ring 714 is inside the spool cores 712, 713, or outside the spool cores 712, 713. In still other implementations, the coupling ring 714 may be comprised of a stretch material that may be stretch to fit around the ends of the spool cores 712, 713, but then tightens to prevent the spool cores from rotating at different rates. In still other implementations, the coupling ring may comprise tape or other adhesive material wrapped around abutting ends of the spool cores 712, 713. In another implementation, the coupling ring 714 may comprise a clamp that is closed around abutting ends of the spool cores 712, 713.

Figure 15:
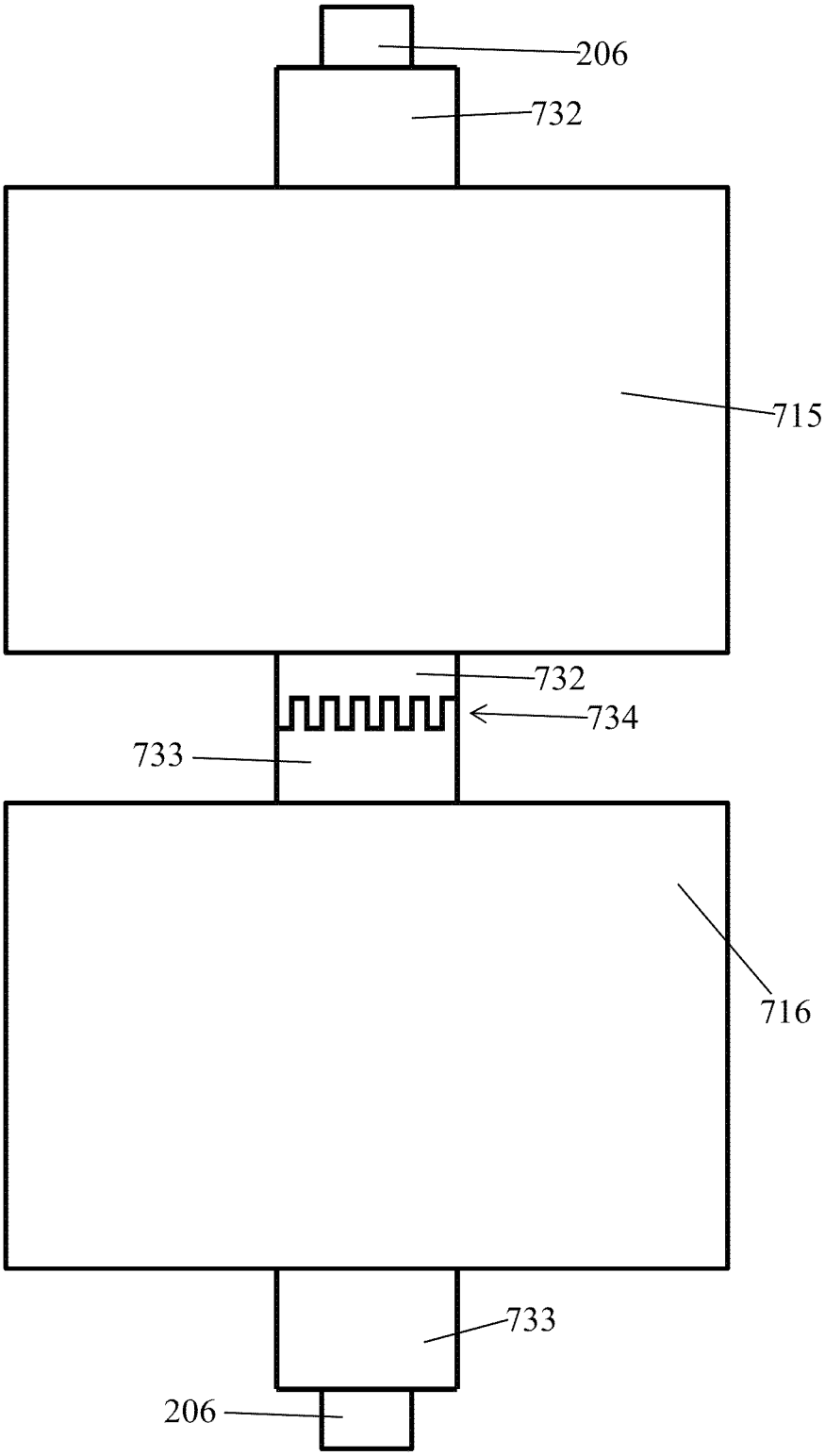
FIG. 15 is a side view of an implementation comprising two spool cores coupled together with integrated coupling clips in the form of coupling teeth.

Referring specifically to FIG. 15, in some implementations, the first spool core 732 and the second spool core 733 may be coupled together with a series of coupling clips 734 in the form of coupling teeth 734. The coupling teeth 734 may comprise any shape, size, or configuration that allows the teeth of the first spool core 732 to fit within gaps between the teeth of the second spool core 733, and vice versa. When engaged, with each other, the coupling teeth 734 prevent the spool cores 732, 733 from rotating at different rates as the rolls of stretch film 715, 716 are unwound or unrolled. The use of adhesives or a secondary coupling device may be utilized to enhance the effectiveness of the coupling teeth 734.

Figure 16:
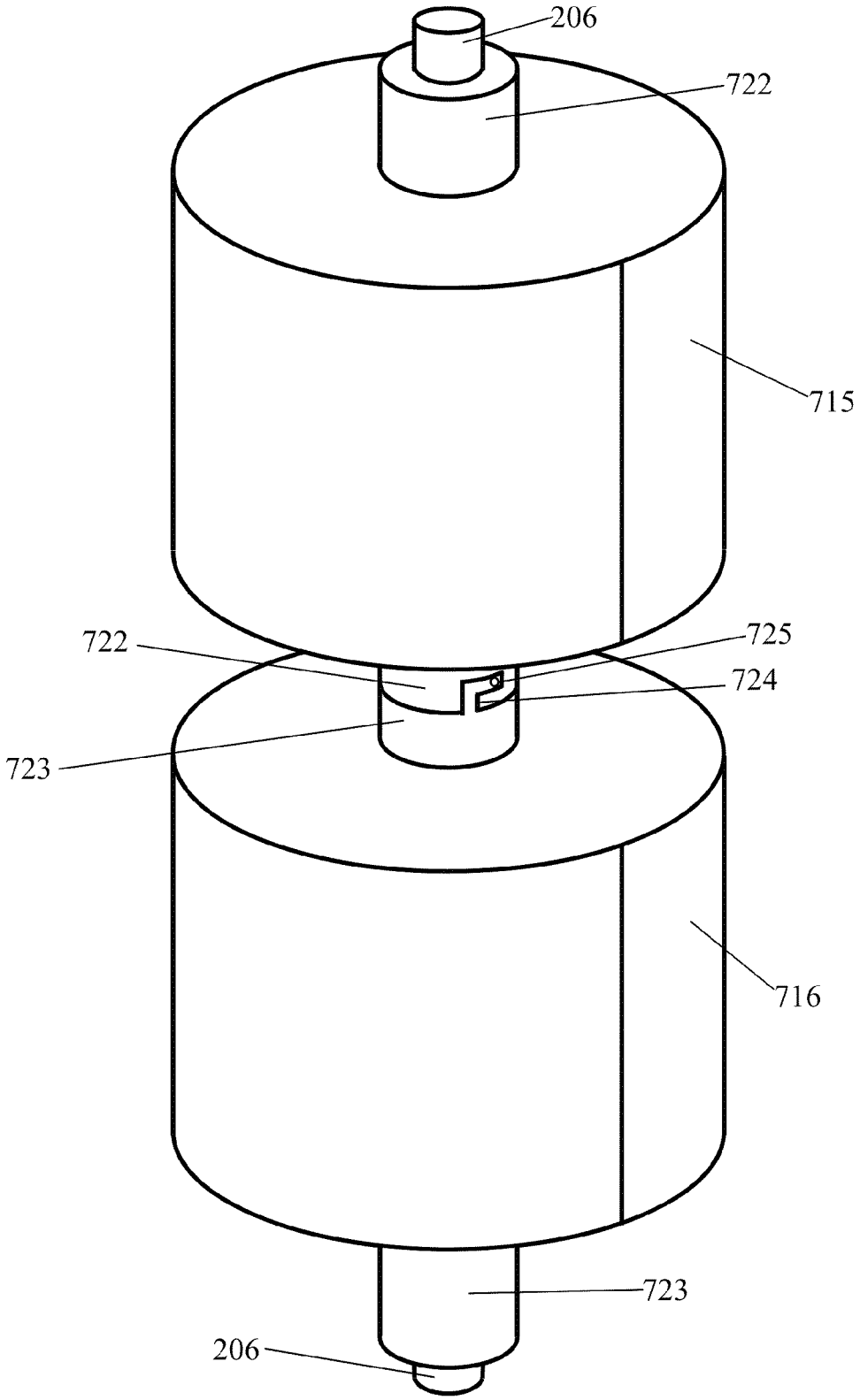
FIG. 16 is a perspective view of an implementation comprising two spool cores coupled together with a mated raised protrusion and angled slot.

Referring specifically to FIG. 16, in some implementations, an end of the second spool core 723 may fit within an end of the first spool core 722 with a coupling clip configured thereon. In the specific implementation of FIG. 16, the second spool core 723 comprises a coupling clip in the form of a protruding nub 725 that fits into an angled channel or reentrant opening 724 on the first spool core 722. When engaged in the reentrant opening 724, the nub 725 may act to lock the first 722 and second 723 spool cores together.

In other implementations, wherein an end of the second spool core 723 fits within an end of the first spool core 722, the spool core 722, 723 may be coupled together with a pin that fits within matching holes on the spool core 722, 723. In some implementations, the pin may also fit within a hole or depression on the support member 206.

In another implementation, the second spool core 723 may comprise a coupling clip in the form of a spring-loaded button and the first spool core may comprise a coupling clip in the form of a hole sized to fit the button within the hole. A user or a machine may then depress the button as the second spool core 723 is slid within the first spool 722. When the button meets the area of the hole of the first spool core 722, the spring forces the button out, thus locking the end of the second spool core 723 in place such that both the first 722 and second 723 spool cores rotate at the same rate as the rolls 715, 716 are unwound.

In another implementation, an end of the second spool core 723 may comprise a coupling clip in the form of exterior threading that allows the end of the second spool core 723 to be screwed into corresponding coupling clip in the form of interior threading on the inside of an end of the first spool core 722.

Figure 7:
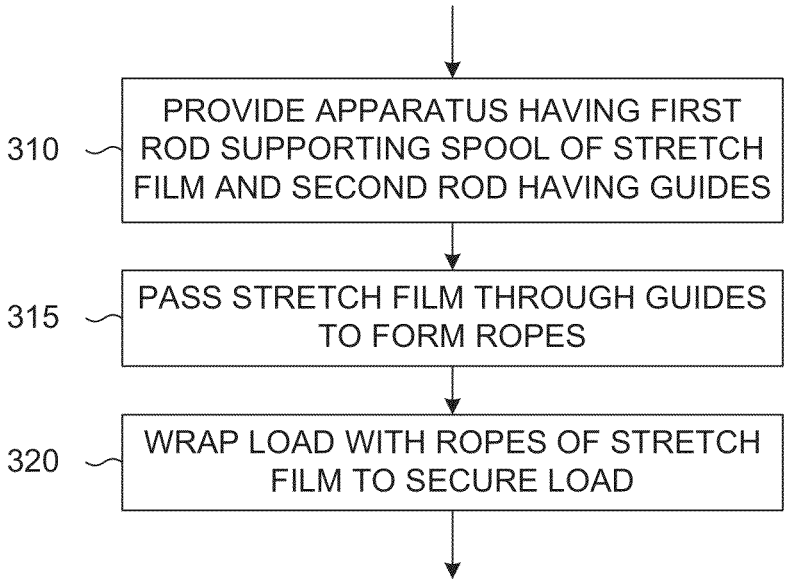
FIG. 7 is a flow diagram describing a particular implementation of a method of securing a palletized load.

FIG. 7 is a flow diagram describing a particular implementation of a method of securing a palletized load. According to this implementation of the method, an apparatus is provided, the apparatus having a first rod that supports a single spool supporting a plurality of rolls of stretch film and a second rod that supports a plurality of guides (step 310). The plurality of rolls of stretch film may be disposed on the single spool in essentially adjacent positions, i.e., substantially contiguously. As a particular example, the apparatus described supra with reference to FIG. 6 may be provided, wherein the apparatus comprises a spool support member 206, which may be a rod, supporting the spool 202 on which are wound first and second rolls of stretch film 215 and 216 disposed substantially contiguously. The second rod of the implementation of FIG. 7 may be implemented as, for example, the guide support member 261 illustrated in FIG. 6, the guide support member 261 being rigidly supported by the platform 205 and the bracket 210, and having pairs of guides 220 adjustably secured thereto by the plurality of collars 230.

The implementation of the method of FIG. 7 further comprises passing stretch film from the plurality of rolls through the plurality of guides to form a plurality of ropes of stretch film (step 315). As a specific example, FIG. 6 illustrates stretch film from first roll 215 and second roll 216 passing through guides formed by pairs of rollers 220 to form first rope 280 and second rope 281 of stretch film. As another example, FIG. 1 illustrates stretch film from first roll 15 and second roll 16 passing through ring-shaped first and second guides 30 and 31 to form first and second ropes of stretch film 50 and 51.

The implementation of the method illustrated in FIG. 7 still further comprises securing the palletized load by wrapping the palletized load with the plurality of ropes formed in step 315, thereby securing the palletized load (step 320). It should be noted that no cutting of stretch film is employed in the illustrated implementation of the method. Exemplary implementations of this securing step (i.e., step 320) are illustrated in FIGS. 2 and 5A. In FIG. 2, a user may transport a palletized load-wrapping apparatus around a palletized load, thereby securing the palletized load with first and second ropes 50 and 51 of stretch film. The first and second ropes 50 and 51 are formed by passing the stretch film through first and second guides 30 and 31. In FIG. 6, a stretch machine 270, operating as described herein, secures a palletized load 295 by wrapping first and second ropes 280 and 281 around the palletized load 295 as the palletized load 295 rotates. First and second ropes are formed by passing stretch film through guides formed by pairs of rollers 220. Neither the implementation of FIG. 2 nor the implementation of FIG. 6 includes a mechanism for cutting stretch film, nor does the implementation of FIG. 7 contemplate any cutting of stretch film.

Figure 8:
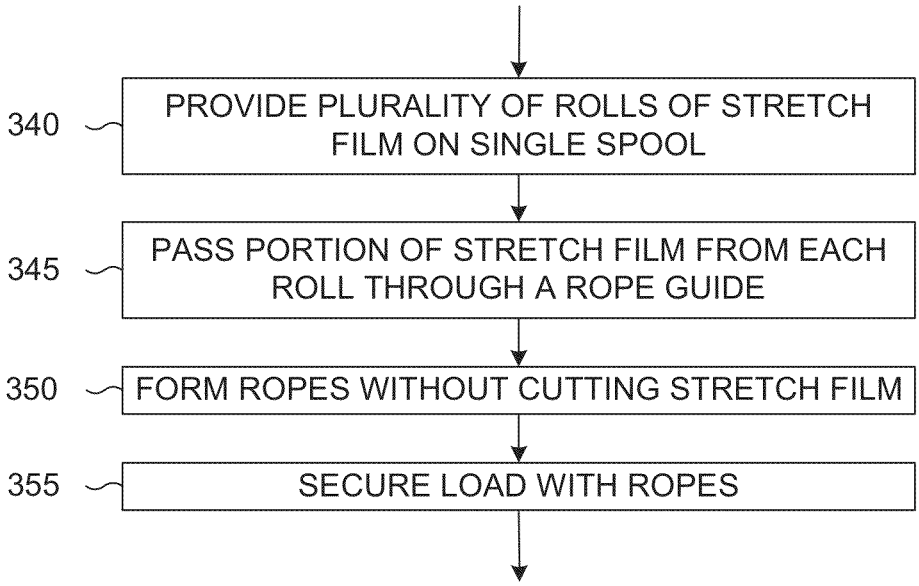
FIG. 8 is a flow diagram describing a particular implementation of a method of protecting a palletized load.

FIG. 8 is a flow diagram describing another particular implementation of a method of protecting a palletized load. According to the illustrated implementation, a plurality of rolls of stretch film (e.g., two or more rolls) is provided on a single spool (step 340). In a typical implementation, the single spool has an axis. A particular implementation that provides a plurality of rolls of stretch film is illustrated in FIG. 1, wherein is illustrated first and second rolls 15 and 16 of stretch film provided essentially contiguously positioned on a single spool 2. Another particular implementation that provides such a plurality of rolls of stretch film is shown in FIG. 6, which shows first and second rolls 215 and 216 on single spool 202.

The implementation of FIG. 7 further comprises passing a portion of stretch film from each roll through a rope guide (step 345). For example, stretch film from each of the first and second rolls 15 and 16 of stretch film may be passed through respective first and second guides 30 and 31 (functioning as rope guides) in the particular implementation shown in FIG. 1. As another example, FIG. 6 illustrates stretch film from each of first and second rolls 215 and 216 of stretch film passed through guides formed by pairs of rollers 220, the guides functioning as rope guides.

The implementation of FIG. 8 still further comprises forming a plurality of ropes without cutting the stretch film (step 350). One particular implementation of a method of forming the plurality of ropes is illustrated in the flow diagram of FIG. 9, described infra.

The implementation of FIG. 8 yet still further comprises securing the palletized load with the plurality of ropes (step 355). The securing may be accomplished using particular implementations already described. For example, FIG. 2 illustrates a pair of users cooperating to secure a palletized load. A first user (i.e. one having first arm 80 and second hand 81) moves around a palletized load while supporting an apparatus 10 adapted to form first and second ropes 50 and 51 of stretch film. A second user having hand 82, grasps initial ends of the first and second ropes 50 and 51. As the first user moves around the palletized load, the first and second ropes 50 and 51 become extended, wrapping, and thereby securing, the palletized load. As another example, a palletized load 295 may be secured as illustrated in FIG. 6 by first and second ropes 280 and 281 of stretch film formed by a stretch wrap machine 270 operating as described herein. As the palletized load 295 rotates on the rotatable platform 213, first and second ropes are extended and wrapped around the palletized load 295 to secure the palletized load 295.

Figure 9:
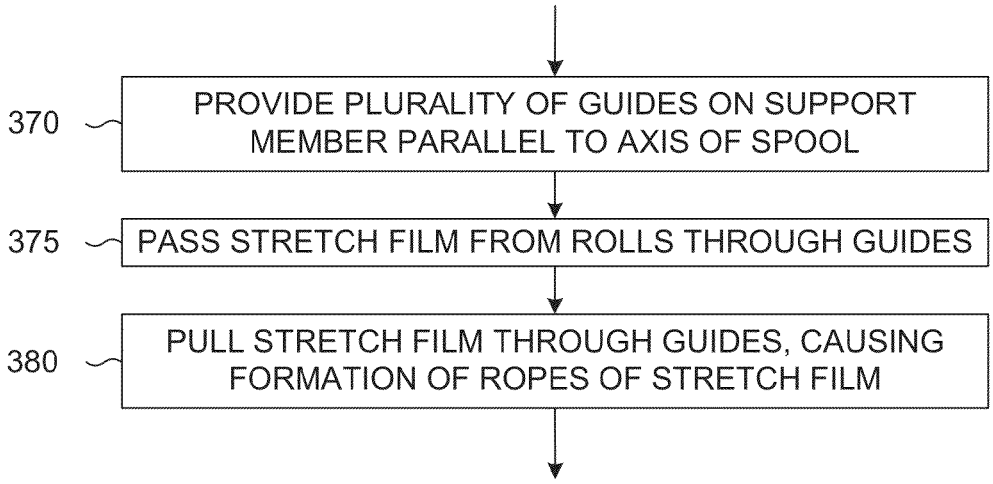
FIG. 9 is a flow diagram depicting a particular implementation of a method of forming a plurality of ropes according to the flow diagram of FIG. 8.

FIG. 9 is a flow diagram depicting a particular implementation of a method of forming a plurality of ropes according to the flow diagram of FIG. 8. The illustrated implementation comprises providing a plurality of guides (step 370) adjustably secured to a support member disposed parallel to the axis of the spool referenced in step 340 of FIG. 8. For example, the providing of guides may be accomplished as illustrated in FIG. 2, wherein first and second guides 30 and 31 are adjustably secured to guide support member 20 by first and second collars 35 and 36. Guide support member 20 is secured in a position having its axis oriented in a direction parallel to an axis of the spool 2 by baseplate 40. In FIG. 6, a pair of guides is provided, each guide formed by a pair of rollers 220 adjustably secured to a guide support member 261 by collars 230, wherein the axis of the guide support member 261 is nominally parallel to the axis of the spool 202 as already described. The particular implementation of FIG. 9 further comprises passing stretch film from the plurality of rolls through the plurality of guides (step 375). See, for example, FIG. 1, wherein stretch film from first roll 15 and second roll 16 is passed through, respectively, first guide 30 and second guide 31. Similarly, in FIG. 6, stretch film from first roll 215 passes through a guide formed by a pair of rollers 220, and stretch film form second roll 216 passes through another guide formed by another pair of rollers 220.

The particular implementation of FIG. 9 still further comprises pulling stretch film through the plurality of guides in order to cause formation of the plurality of ropes of stretch film (step 380). This step may be accomplished as illustrated in FIG. 1 wherein, for example, first rope 50 is bunched up as stretch film from first roll 15 passes through the first guide 30, thereby forming the first rope 50. Additional ropes may be similarly formed. In FIG. 5, first rope 180 is formed when stretch film from a first roll is guided by a pair of rollers 120.

Figure 12:
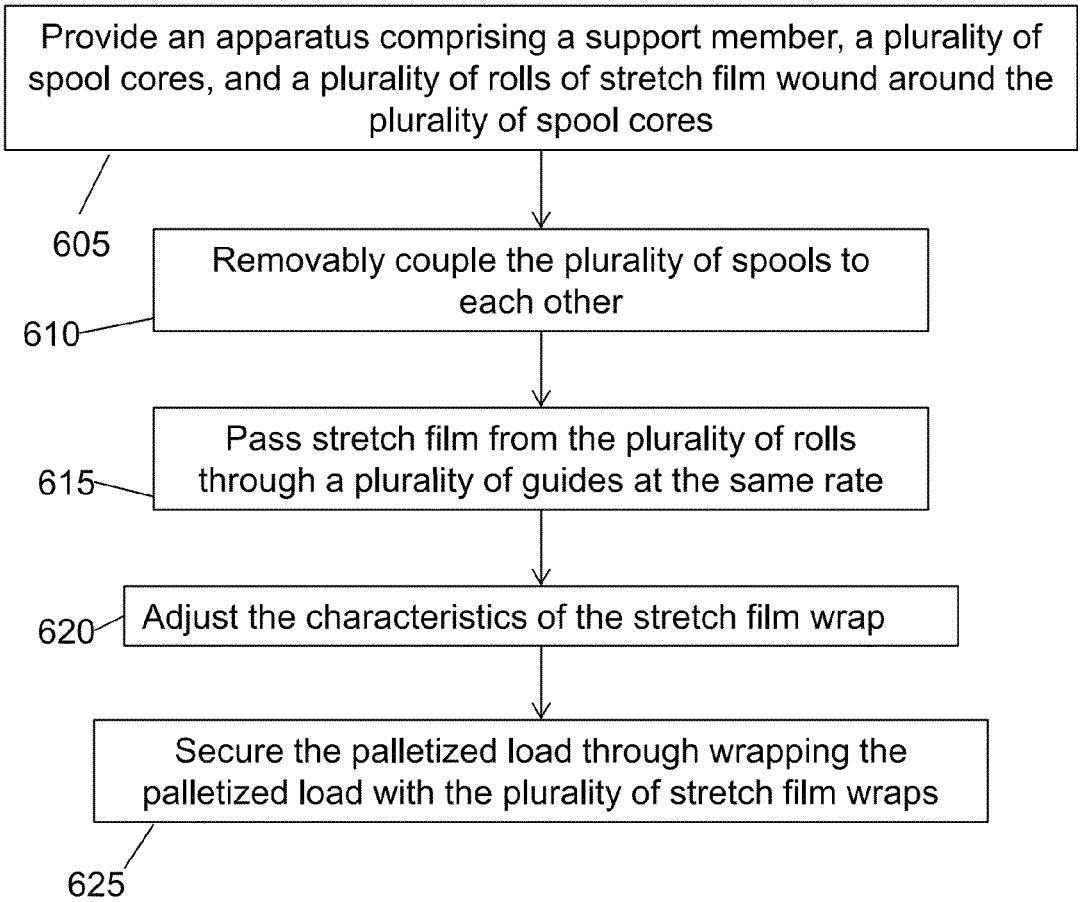
FIG. 12 is a flow diagram describing a particular implementation of a method of wrapping a palletized load.

FIG. 12 is a flow diagram depicting a particular implementation of a method of securing a palletized load. In an implementation, the method may comprise providing an apparatus comprising a support member, a plurality of spool cores, and a plurality of rolls of stretch film wound around the plurality of spool cores (step 605), at least one roll of stretch film on each of the plurality of spool cores. In an implementation of the method, the plurality of spool cores may comprise a first and at least a second spool core. The plurality of rolls of stretch film may comprise a first roll of stretch film and at least a second roll of stretch film. In various implementations, the plurality of rolls of stretch film wound around the plurality of spool cores may comprise the first roll of stretch film wound around the first spool core and the second roll of stretch film wound around the second spool core.

In an implementation, the method may further comprise removably coupling the plurality of spools to each other (step 610). Removably coupling or coupling the plurality of spools together in general ensures that all the plurality of spool cores rotate at the same rate when the plurality of rolls of film are unrolled.

In an implementation, the method may further comprise passing the stretch film from the plurality of rolls through a plurality of guides at the same rate (step 615). As the stretch film is passed from the plurality of rolls through the plurality of guides, a plurality of stretch film wrap bands or ropes are formed.

In an implementation, the method may further comprise adjusting the characteristics of the stretch film wrap (step 620). Adjusting the characteristics of the stretch film may comprise adjusting a width of one of the plurality of adjustable guides through which one of the plurality of stretch film wrap passes.

In an implementation, the method may further comprise securing the palletized load through wrapping the palletized load with the plurality of stretch film wraps (step 625). This may be accomplished after passing the stretch film through the plurality of adjustable guides.

It should be emphasized that positions of guides in the particular implementations of methods described in FIGS. 6-8 and FIG. 12 are adjustable as described with reference to, for example, FIG. 1 and FIG. 6. In a case of guides formed as rings (see, for example, FIG. 1), the rings may be adjusted either in a ganged arrangement or independently. Likewise, the guides formed by rollers 220 (FIG. 6) may be three-way adjustable: 1) Pairs of rollers may be moved in a ganged fashion; 2) pairs of rollers may be moved independently; and 3) rollers forming a pair may be moved farther apart or closer together in order to change a characteristic of ropes of stretch film according to preferences of a user.

Figure 10A:
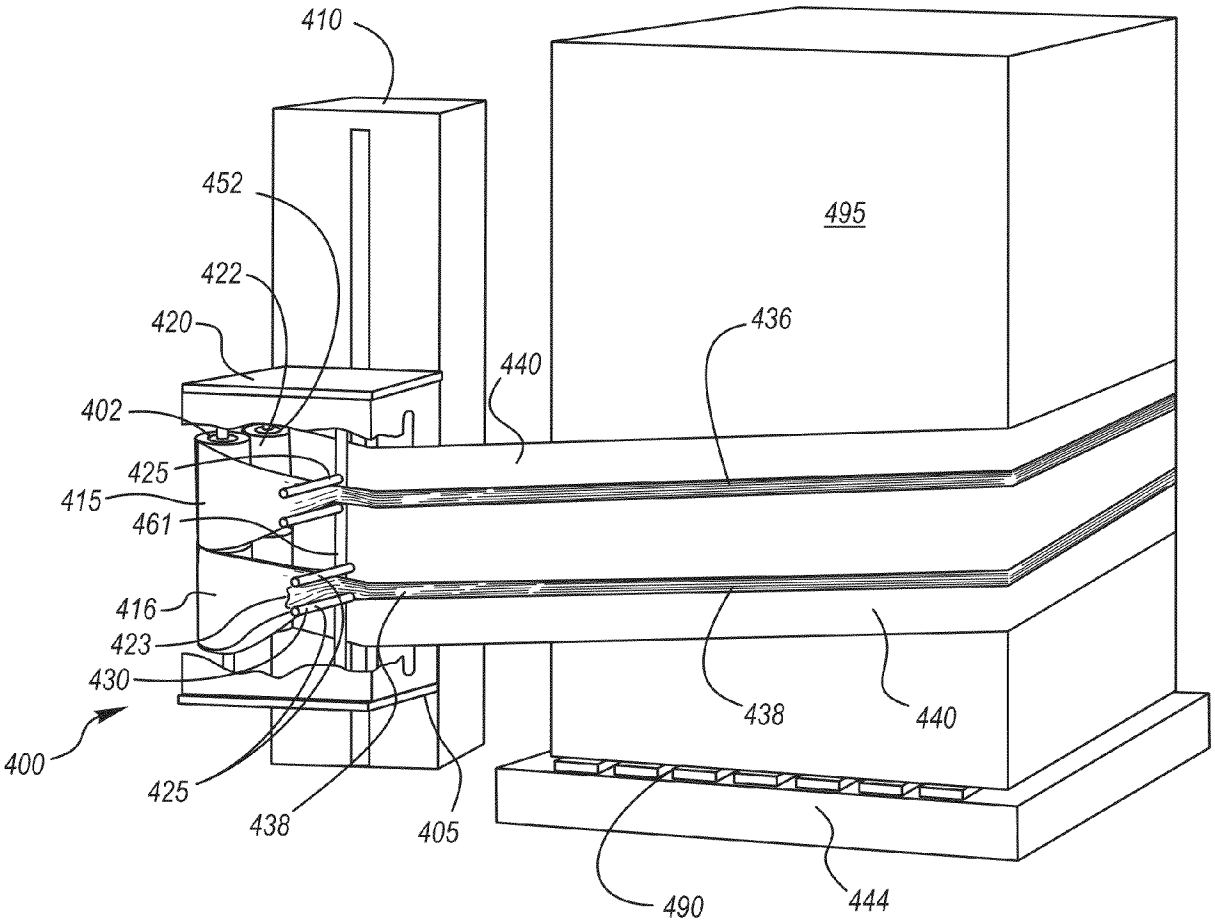
FIGS. 10*a* and 10*b* are, respectively, two embodiments of a stretch wrap machine using a pre-stretch carriage.

FIG. 10*a* is a pictorial diagram of a stretch wrap machine 400 that may include elements described with reference to FIG. 6. The illustrated implementation comprises carriage 405, moveably coupled to a carriage support 410. During operation of the stretch wrap machine 400, the carriage 405 is mechanically moved up and down the support 410 through a combination of gears and drives. A comparable carriage support and carriage system currently on the market is the SMH-200 Stretch Wrapper, sold by Wulftec International of QC, Canada. Those of ordinary skill in the art readily understand the use and operation of a conventional stretch wrapping machine of this type. FIG. 10*a* includes on the carriage 405 a conventional pre-stretch carriage 420 configured to stretch the stretch film passed through it prior to applying the stretch film to a pallet of goods to be wrapped, and at least one roll of stretch film 422 on a first spool 452. Stretch film from spool 452 may be referred to as a web 440. Different from a conventional stretch wrapping machine, however, the implementation of FIG. 10*a* includes at least a second roll of stretch film 415 or 416 supported on the carriage by a second spool 402. For this particular implementation, the stretch film web 440 from the first roll of stretch film 422 is simultaneously fed through the pre-stretch carriage 420 with the stretch film 436 and 438 from the at least a second roll of stretch film 415 or 416 after it has passed through guides 420. Typically, first and second rolls 415 and 416 are disposed next to each other on the second spool 402. The first and second rolls 415 and 416 may be disposed directly on the spool or disposed on separate spools that are then disposed on a common spool or roller (e.g. a common core with two spools around it and coupled to it) with the purpose that the first and second rolls necessarily unroll at substantially the same rate. If the first and second rolls 415 and 416 do not spin at substantially the same rate, as is necessitated by being on the same spool 402 or being otherwise equivalently forced to spin at substantially the same rate, the operation is less effective. In an alternative embodiment, only a single roll 416 is mounted on the second spool 402 and the film from the two separate rolls simultaneously feed through the pre-stretch carriage.

A guide support 461, which is also supported by and coupled to the carriage 405 and at a second end by bracket 410, may be disposed nominally parallel to and at a convenient distance from the second spool 402. That is, guide support 461 may have an axis that is parallel to the axis of the spool 402. A plurality of rollers 425, which may be arranged in pairs to form guides, two of which are illustrated, for example, in FIG. 10*a*, are adjustably connected with the guide support member 461 by a plurality of collars 430. The plurality of rollers 425 is positioned such that stretch film from first and second rolls 415 and 416 pass through the guide. The collars 430 may be configured so that positions of the plurality of rollers 425 may be adjusted. The space between the guides 425 is the guide width 423. Alternatively, multiple guides extending from a common post may be coupled to the guide support member 461 to establish a guide width 423. The guide width 423 is less than the width of either the first and second roll 415 and 416, such that when stretch film is passes from first and second rolls 415 and 416 through roller guides 425, the width of each stretch film is narrowed to what is commonly referred to as a "rope" or alternatively referred to as a "band".

Figure 10B:
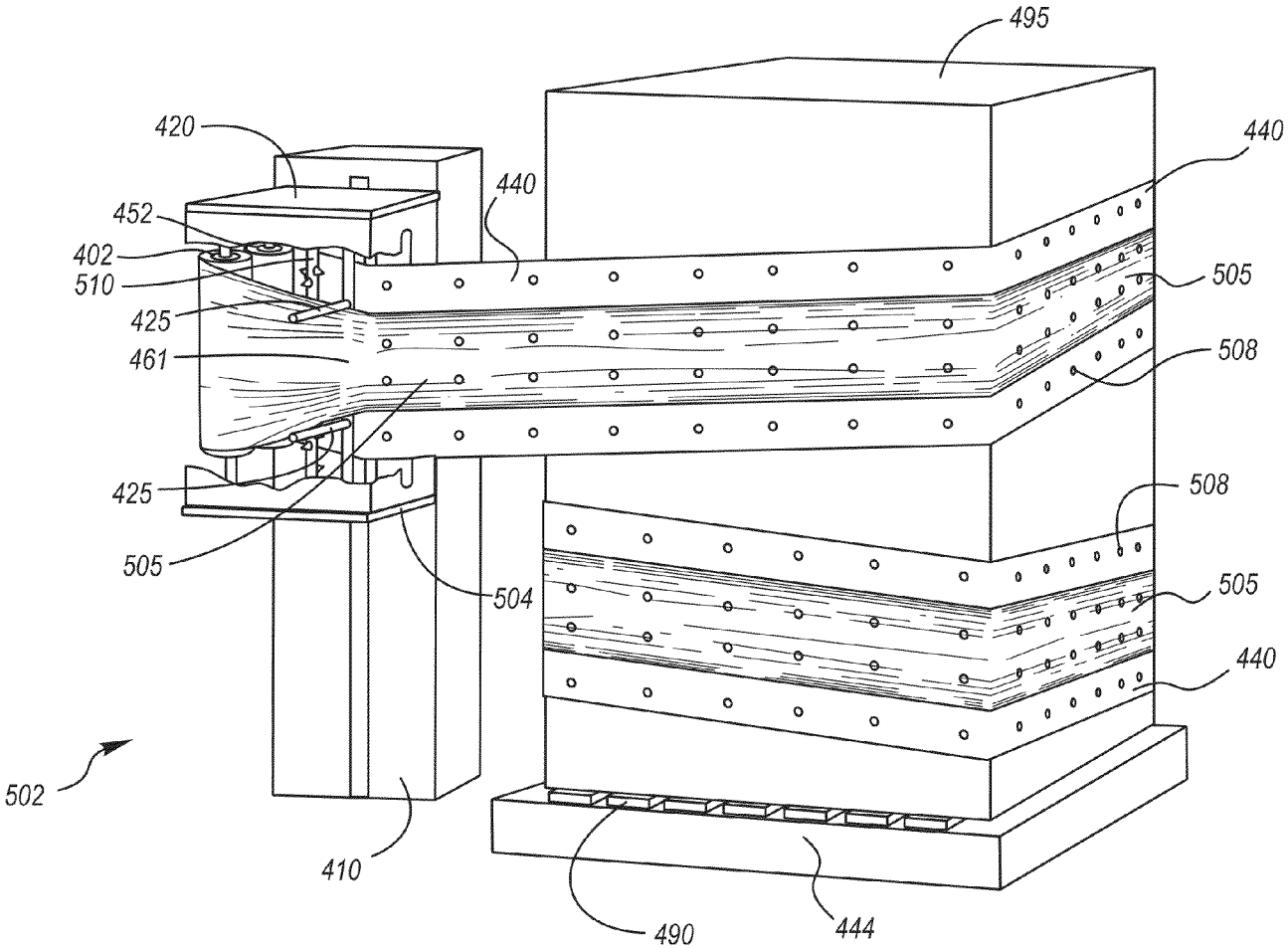

As stretch film from the first and second rolls 415 and 416 passes through a pair of guides (formed by pairs of rollers 425 in the implementation shown in FIGS. 10*a* and 10*b*), first and second ropes 436 and 438 of stretch film are formed. This disclosure, further, contemplates using one roll or two or more rolls. A plurality of rolls of stretch film in order to form a plurality of ropes of stretch film by passing the stretch film through a plurality of guides could be more than two although only two rolls, guides and ropes are illustrated in FIG. 10*a*.

FIG. 10*b* illustrates another particular implementation of a pallet wrapping system 502 with a carriage 504 moveably mounted to a support 410 as with the particular implementation of FIG. 10*a*, but this particular implementation includes a spool 402 with only a single roll of stretch film 505 wound around the spool 402 (rather than the two rolls 415 and 416 of FIG. 10*a*). The setup for FIG. 10*b* still includes the guides 425 and guide support 461, but only one set of guides 425 to form only one wide rope 505. As illustrated, the first spool 452 feeds a web of stretch wrap 440 over a perforating spindle 510 having a plurality of pins/needles/spikes extending from it to perforate the web of stretch wrap 440 feeding across it before it enters the pre-stretch carriage 420.

Although, for purposes of clear illustration FIGS. 10*a* and 10*b* are shown to simultaneously dispose the web 440 and the ropes 436 and 438 or 505 on the palletized load with the web 440 closest to the load, this is not required and in some cases not preferred. In alternate implementations of any of the various embodiments described throughout this disclosure may be accomplished by simply reversing the positions of the rolls, or by wrapping the palletized load the other direction. In such implementations, the ropes 436 and 438 or 505 will be simultaneously disposed on the palletized load with the web 440 with the ropes 436 and 438 or 505 closest to the palletized load. In particular applications it may be desirable and advantageous to have the web 440 closest to the load while wrapping and in other applications it may be desirable and advantageous to have the web 440 covering the ropes 436 and 438 or 505 depending upon the type of load being wrapped and whether the web 440 and/or ropes 436 and 438 or 505 are perforated.

In particular implementations, such as that shown in FIG. 10*b*, the stretch film rope 505 from the second spool 402 may be fed across the perforating spindle 510 with the web of stretch wrap 440 to perforate it as well. As the stretch wrap 440 is stretched in the pre-stretch carriage 420 and applied to the pallet load 495, the perforated holes 508 are stretched much larger than their initial diameter forming a netting to allow air flow to the product being wrapped. It is contemplated that embodiments like that illustrated in FIG. 10*b* where the stretch wrap rope 505 does not become perforated, the rope maintains its full strength, but that other embodiments may perforate the rope/band as well or that in other particular implementations a separate perforating spindle with fewer pins/needles/spikes may be used for the rope to provide some air flow but not weaken the rope too much.

Figure 11A:
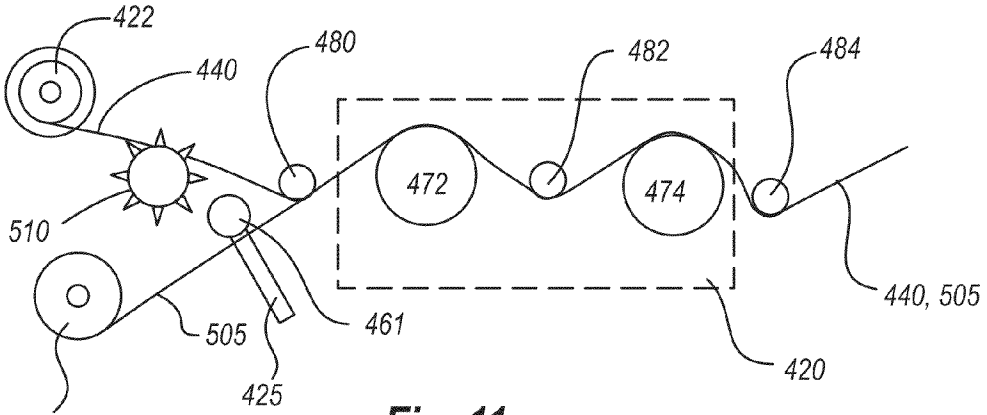
FIGS. 11*a* and 11*b* are, respectively, representative top and side views of the path of stretch film travel from the rolls of stretch film through one particular embodiment of a pre-stretch carriage.
Figure 11B:
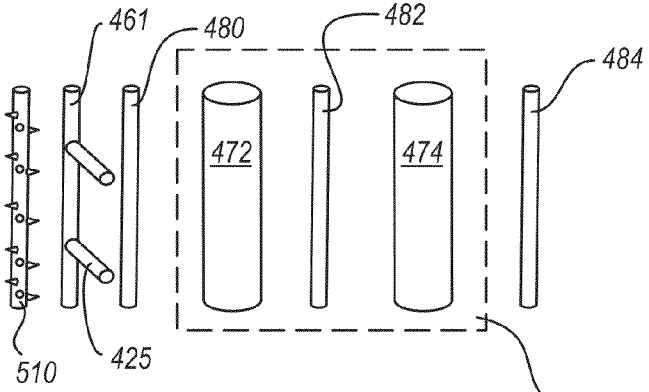

A pre-stretch carriage 420 may comprise any combination of rollers and components to pre-stretch the film being passed through it prior to applying the film to the pallet load 495 being wrapped. In the particular implementation illustrated by the rollers in FIGS. 11*a* and 11*b*, the pre-stretch carriage 420 comprises pre-stretch rollers 472 and 474 and idle roller 482. FIG. 11*a* represents the path of the various stretch films 440 and 505 as they pass from the spools 402, 452 through the pre-stretch carriage 420 on their way to the pallet load 495 FIG. 10*a*) to be wrapped. FIG. 11*b* represents the various components without the particular housing or the film shown for clarity. Adjacent to pre-stretch carriage 420 are idle rollers 480 and 484. It should be understood that idle rollers 480 and 484 may also be located within pre-stretch carriage 420 with no change in functionality and that other particular configurations may alternatively be used. Pre-stretch rollers 472 and 474 may be of different diameters, causing the stretch film to become stretched as it passes through pre-stretch carriage 420.

FIG. 11*a* shows a top view of pre-stretch carriage 420 to illustrate the path taken by one or more stretch wrap ropes 505 and stretch wrap web 440 as they simultaneously traverse through pre-stretch carriage 420. In this particular implementation, only one stretch wrap rope 505 is illustrated, though as with other embodiments shown and described herein, multiple stretch wrap ropes may be used. Stretch wrap web 440 passes over the perforating spindle 510, where it is perforated as described above. Thereafter, the combination of the one or more stretch wrap ropes 505 and the stretch wrap web 440 wind past idle roller 480, pre-stretch roller 472, idle roller 482, pre-stretch roller 474, and idle roller 484. Pre-stretch rollers 472 and 474 may be of different diameters. Thus, as the one or more stretch wrap ropes 505 and the stretch wrap web 440 pass through the rollers, the different diameters of pre-stretch rollers 472 and 474 cause the ropes 505 and web 440 to stretch simultaneously. It should be understood that other configurations of pre-stretch carriage 420 may be used in conjunction with stretch wrap machines 400, 502.

The stretch wrap system 400, 502 may comprise a common support (not shown) for the carriage support 410 and a rotatable platform 444 on which may be placed a pallet 490 with a load 495 of palletized goods. The arrangement of the load 495 is not critical to this disclosure and has been shown as a non-descript cube for simplicity.

In operation, and with reference to the respective portions of both FIGS. 10*a* and 10*b*, the pallet 490 and the palletized load 495 may arrive at the stretch wrap machine 400, 502 and may be placed onto the rotatable platform 444. One or more stretch wrap ropes 436, 438 and 505 may be formed as described herein in addition to the stretch wrap web. As illustrated in FIG. 11*a*, a portion of the path of the stretch wrap ropes 436, 438 and 505 from the second spool 402 to the palletized load 495 overlaps with a portion of the path of stretch wrap web 440 from the first spool 452 to the palletized load 495 after the one or more stretch wrap ropes 436, 438 and 505 pass through guides 425 so that the one or more ropes and the stretch wrap web 440 are applied to the palletized load 495 simultaneously. In one embodiment, a pre-stretch carriage 420 is along the overlapping path such that the paths overlap through pre-stretch carriage 420. Then the ropes and web 440 combination are attached at initial ends (not illustrated) to the palletized load 495 in a known manner. The rotatable platform 444 then may be rotated (using, for example, a known type of motor and shaft arrangement as is conventional with this type of stretch wrapping system), thereby pulling stretch film through the guides and extending the at least one rope 436, 438 and 505 and the stretch wrap web 440 to wrap the palletized goods 495 as already described. The carriage 420 is moved up and down on the carriage support 410 as the pallet turns to wrap the pallet, overlapping combinations of previously simultaneously applied rope and web layers. It should be understood that the use of pre-stretch carriage 420 is optional as is the perforating spindle 510. The combination of one or more ropes 436, 438 and 505 with stretch wrap web 440 may be performed without pre-stretching.

It will be understood that implementations are not limited to the specific components disclosed herein, as virtually any components consistent with the intended operation of a method and/or system implementation for securing palletized loads may be utilized. Accordingly, for example, although particular components may be disclosed, such components may comprise any shape, size, style, type, model, version, class, grade, gauge, measurement, concentration, material, weight, quantity, and/or the like consistent with the intended operation of a method and/or system implementation for a palletized load wrapping machine may be used. By specific example, another method and apparatus for wrapping a palletized load known in the art involves a palletized load remaining stationary and the wrapping carriage moving up and down and around the palletized load. It is specifically contemplated that the wrapping carriages of these methods and apparatus would be readily modified by those of ordinary skill in the art to include the advantages of the wrapping carriages and machines identified in this disclosure. Accordingly, it is considered within the scope of this disclosure to include such methods and apparatus adapted to include the carriages and methods described within this disclosure relating to rotating palletized loads.

In places where the description above refers to particular implementations of palletized load-wrapping apparatus, it should be readily apparent that a number of modifications may be made without departing from the spirit thereof and that these implementations may be applied to other forms of devices that secure palletized loads. In particular, the above description describes hand-held and stationary versions of palletized load-wrapping machines. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

It is claimed:

1. An apparatus for securing a palletized load, the apparatus comprising:

a plurality of spool cores removably coupled to each other by a coupling clip and supported by a spool support member, the coupling clip directly contacting at least one end of each of the plurality of spool cores;

a first roll of stretch film wound around a first spool core of the plurality of spool cores and at least a second roll of stretch film wound around at least a second spool core of the plurality of spool cores such that the first spool core and the at least a second spool core are rotationally coupled to the respective first roll and at least a second roll of stretch film, respectively, wherein the first roll, the at least a second roll, the first spool core, and the at least a second spool core all rotate at the same rate when the first roll and the at least a second roll are unrolled through the first and second spool cores being rotationally coupled together by the coupling clip; and a plurality of guides positioned adjacent to the spool support member, each guide having stretch film from one of either the first roll or the at least second roll passed through the guide, thereby forming a plurality of stretch film wraps passing through the plurality of guides, wherein a width of the stretch film wrap passing through each of the plurality of guides is determined by a width of the respective guide through which the stretch film wrap passes.

2. The apparatus of claim 1, wherein the coupling clip comprises at least one clip separate from the first spool core and the second spool core, wherein at least one coupling clip is coupled directly to the first spool core and to the second spool core such that the first spool core and the second spool core rotate at the same rate.

3. The apparatus of claim 1, wherein the first and the at least a second spool core are coupled together by a portion of the at least second spool core fitting within at least a portion of the first spool core, and the coupling clip comprises a pin that fits within corresponding holes on each of the first and the at least a second spool core.

4. The apparatus of claim 1, wherein the coupling clip comprises coupling teeth on a first end of each of the first spool core and the at least second spool core, wherein the first and the at least second spool core are coupled together through the coupling clip when the coupling teeth of the first spool core mechanically engage the coupling teeth of the at least a second spool core.

5. The apparatus of claim 1, wherein the first and the at least a second spool core are coupled together through the coupling clip when an extension on the first spool core that engages a receiver on the at least second spool core.

6. The apparatus of claim 1, wherein the first and the at least second spool core are coupled together with a screw such that the first spool core and the second spool core rotate at the same rate.

7. The apparatus of claim 1, wherein a position of each of the plurality of guides is independently adjustable on a guide support member positioned adjacent the spool support member.

8. The apparatus of claim 1, wherein the coupling clip comprises a coupling ring that attaches directly to an end of each of the first spool core and the at least a second spool core.

9. A spool of stretch film for securing a palletized load, the spool comprising:

a plurality of spool cores rotationally coupled to each other such that the spool cores necessarily rotate at the same rate;

at least a first roll of stretch film positionally coupled to and wound around a first spool core of the plurality of spool cores;

at least a second roll of stretch film positionally coupled to and wound around at least second spool core of the plurality of spool cores;

wherein by both the at least first roll of stretch film and the at least second roll of stretch film being positionally coupled to the first spool core and the second spool core, respectively, and by the first spool core being coupled to the at least second spool core, both the at least a first roll of stretch film and the at least a second roll of stretch film will simultaneously rotate at the same rate as the plurality of spool cores when the at least first roll and the at least second roll are unrolled.

10. The spool of stretch film of claim 9, further comprising an axis of rotation of the plurality of spool cores, the at least a first roll comprising a first center axis and the at least a second roll comprising a second center axis, wherein the first center axis and the second center axis coincide with the axis of rotation of the plurality of spool cores.

* * * * *